US006558299B1

(12) United States Patent
Slattery

(10) Patent No.: US 6,558,299 B1
(45) Date of Patent: May 6, 2003

(54) METHOD AND DEVICE FOR ASSISTING WEIGHT LIFTERS IN PERFORMING WEIGHT LIFTING EXERCISES

(76) Inventor: J. Patrick Slattery, 484 Whetstine Ave., Prescott, AZ (US) 86301

( * ) Notice: Subject to any disclaimer, the term of this patent is extended or adjusted under 35 U.S.C. 154(b) by 0 days.

(21) Appl. No.: 09/513,861

(22) Filed: Feb. 28, 2000

(51) Int. Cl.[7] ..... A63B 21/078
(52) U.S. Cl. ..... 482/93; 482/4; 482/104
(58) Field of Search ..... 482/4, 6, 5–9, 482/1, 104, 106, 93

(56) References Cited

U.S. PATENT DOCUMENTS

| | | | | |
|---|---|---|---|---|
| 3,874,658 | A | 4/1975 | Flowers | |
| 4,249,726 | A | 2/1981 | Faust | |
| 4,253,662 | A | 3/1981 | Podolak | |
| 4,650,186 | A | 3/1987 | Parker, III | |
| 4,799,672 | A | 1/1989 | Barrett | |
| 4,807,875 | A | 2/1989 | Tanski | |
| 4,949,959 | A | 8/1990 | Stevens | |
| 5,048,826 | A | 9/1991 | Becker | |
| 5,190,510 | A | 3/1993 | Goodger | |
| 5,281,510 | A | 1/1994 | Colbo | |
| 5,407,403 | A | 4/1995 | Coleman | |
| 5,779,602 | A | 7/1998 | Rodriquez | |
| 5,788,616 | A | 8/1998 | Polidi | |
| 5,823,921 | A | 10/1998 | Dawson | |
| 6,379,287 | B1 * | 4/2002 | Slawinski et al. | 482/104 |

* cited by examiner

*Primary Examiner*—Glenn E. Richman
(74) *Attorney, Agent, or Firm*—The Winarski Firm, PLLC; Tyson York Winarski

(57) ABSTRACT

An automated spotting device for use with free-weight barbells that is comprised of a mechanical device operated by a computerized drive controller. The mechanical device is comprised of a frame having a vertically movable center section that supports two horizontal spotter arms, which spot the barbells. The movable center section is mechanically engaged to an electric motor by a lead screw. The computerized drive controller regulates the operation of the electric motor, thereby moving the spotter arms between upper and lower spot positions, to increase the safety and effectiveness of free-weight training.

20 Claims, 7 Drawing Sheets

METHOD AND DEVICE FOR ASSISTING WEIGHT LIFTERS IN PERFORMING WEIGHT LIFTING EXERCISES

FIELD OF THE INVENTION

The present invention relates generally to the field of athletic and exercise equipment. More particularly, this invention relates to the field of devices and methods for assisting individuals with performing weight lifting exercises in order to prevent injury and to increase the effectiveness of the exercise.

BACKGROUND OF THE INVENTION

A significant problem for free weight lifters is that, in the absence of a human spotter, it is difficult to derive the maximum benefits from lifting the weights. The reason is that it is dangerous to continue an exercise to the point of fatigue, which is the very time when maximum benefit is derived. In other words, the lifter lifting alone must stop lifting when any doubt creeps into his or her mind whether they can perform the next repetition. In lifts where the bar would not be a danger to the lifter if he or she could not do an extra repetition, such as a curl, the lifter still does not derive maximum benefit from the exercise because of the lack of a spotter. Doing bench presses, where the weight lifter lays underneath the free weights, is particularly dangerous without a spotter.

The prior art includes the following United States Patents: Tanski, U.S. Pat. No. 4,807,875; Ryan, U.S. Pat. No. 5,048,826; and Coleman, U.S. Pat. No. 5,407,403. The apparatus disclosed in the '875 patent issued to Tanski has two arms that extend from the sides of a bench press device. These two arms extend underneath an Olympic weight lifting bar. A chain and sprocket assembly, driven by an electric motor, raises and lowers these arms. This device is operated by a switch positioned at the foot of the athlete. In addition, the device is provided with switches that limit the raising and lowering of the arms.

A safety apparatus for use with a barbell assembly is taught by the '826 patent issued to Ryan. This assembly includes a support frame, a pair of cables that extend to engage the barbell, and a winch assembly on the support frame that extends and retracts the cables. In addition, the device is provided with sensors to measure the tension on the cables. Also, the device has sensors to measure the direction and the velocity of the movement of the cable. A controller, such as an Intel 8087 micro-controller, is used to control the operation of the winch assembly.

The '403 patent issued Coleman teaches a weight lifting safety device that has a computerized control system. This device contains a motor driven cable and a sprocket assembly that can be connected to either a barbell or a pair of dumbbells. The device is provided with sensors to track the speed of the motion of the cable. The control system is programmed with the desired velocity profile of the motion of the bar for the exercise. If the weightlifter moves at a pace that is faster or slower than this profile, the control system activates the motor driven cable assembly and takes control of the weight.

SUMMARY OF THE INVENTION

The following electro-mechanical device has a frame which supports two arms, called spotter arms. The two spotter arms extend out so as to be able to support a barbell.

The arms raise and lower on the frame, remaining parallel with the floor and perpendicular to the frame. Thus, this device provides a free weight lifter with assistance in lifting weights when, during the course of the exercise, the muscles are fatigued and the lifter cannot lift the amount of weight on the bar by themselves. This assistance is called a "spot." A control system operates the movement of the two spotter arms. The movement of these two spotter arms is caused by a motor-driven lead-screw. This electro-mechanical device is provided with an electro-optical sensor that provides feed-back information to the control system.

DESCRIPTION OF THE PREFERRED EMBODIMENT

In this specification, all elements that are described in the Figures have three digit numbers. Additionally, this specification uses equations to describe the operation of the invention. All equations are numbered using only one or two digits.

Figure 1:
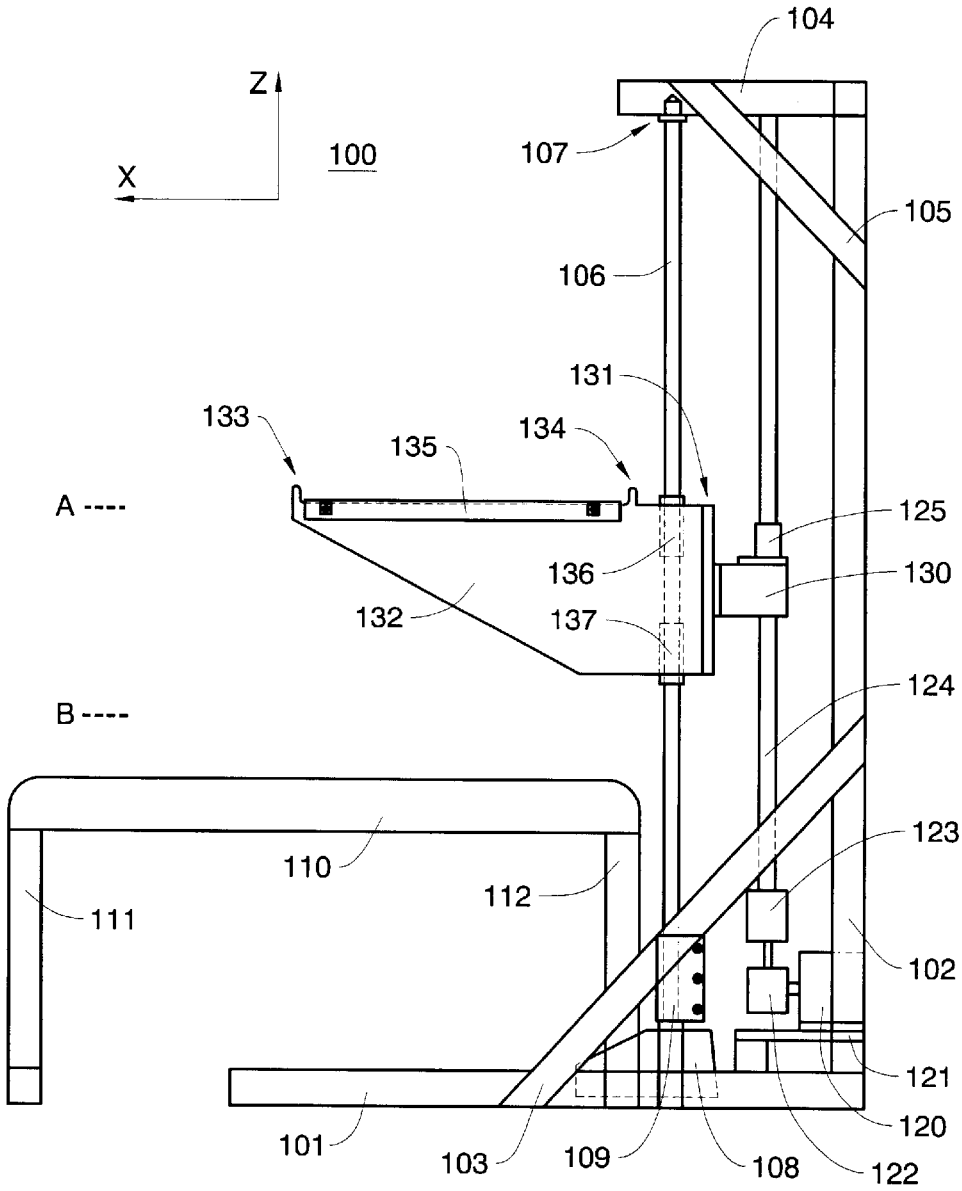
FIG. 1 consists of a side view of the spotter system.
Figure 2:
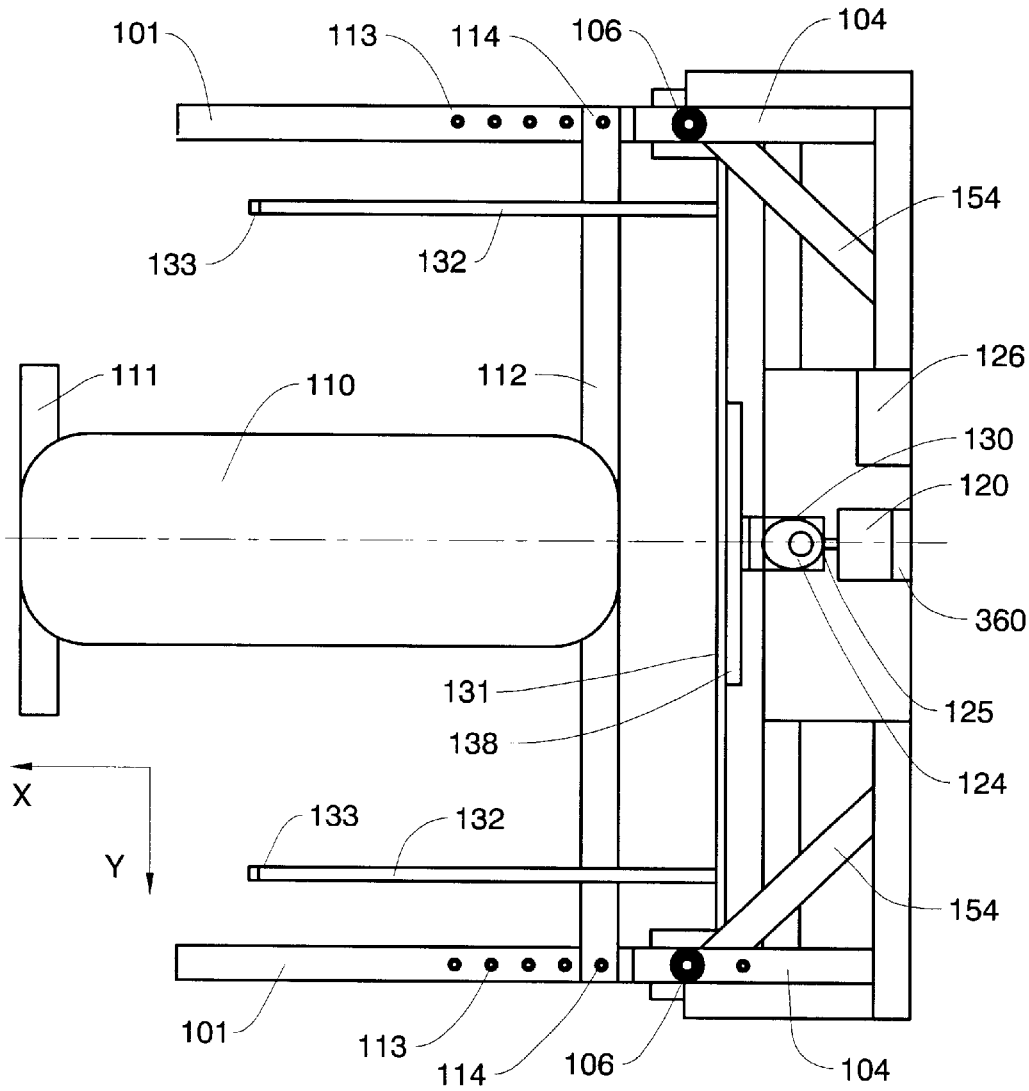
FIG. 2 consists of a top view of the spotter system
Figure 3:
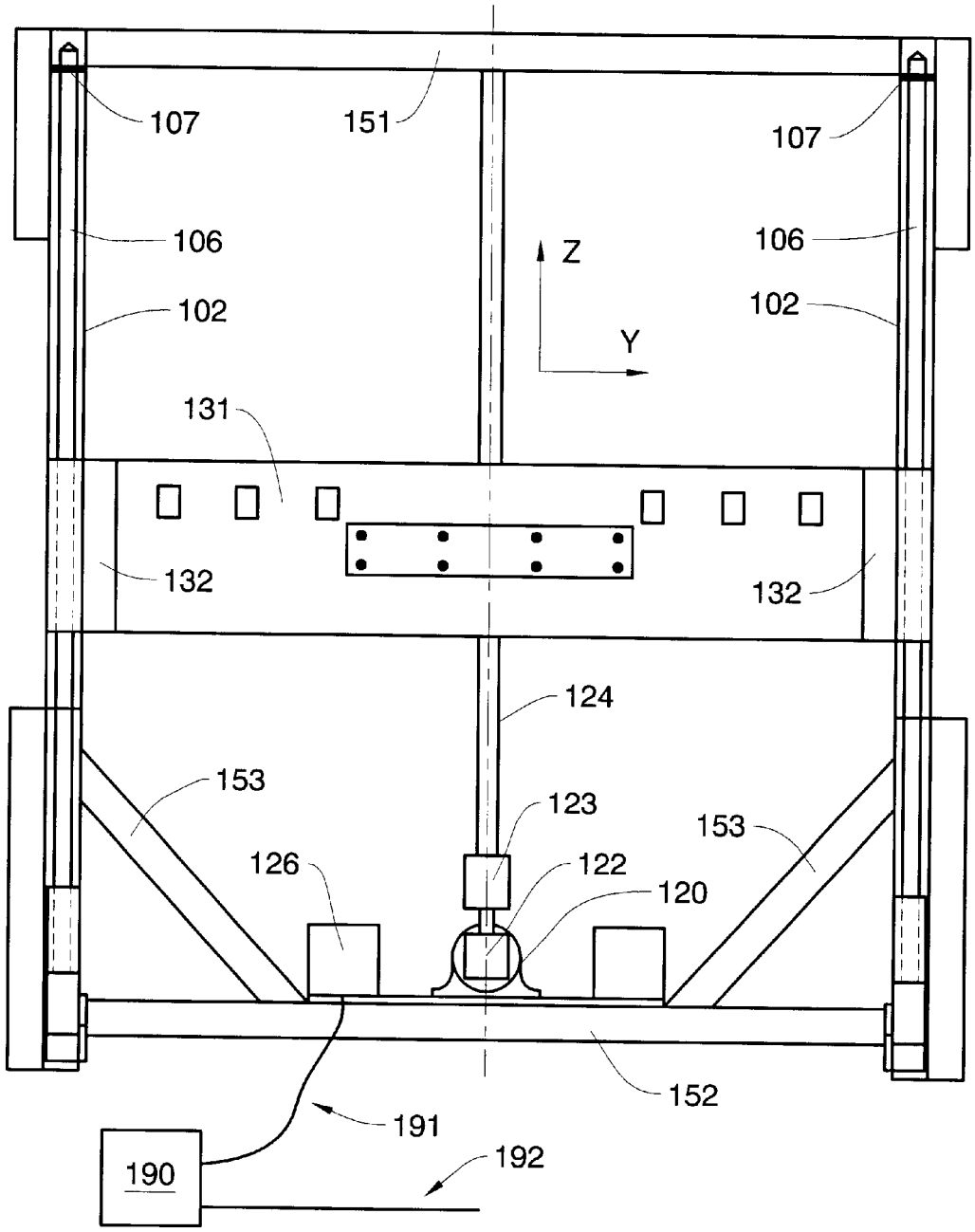
FIG. 3 consists of a front view of the spotter system.

FIG. 1 gives a side view of the spotter system 100. FIG. 2 gives a top view and FIG. 3 gives a frontal view. A pair of horizontal beams 101 forms a base for a pair of vertical beams 102. Two beams 103 each form a stabilizing triangle joint between each horizontal beam 101 and vertical beam 102. Each of two top beams 104 are held in place by vertical beams 102. A pair of beams 105 also form stabilizing triangle joints between top beams 104 and vertical beams 102. Vertical beams 102 are spaced apart by upper lateral beam 151 and lower lateral 152. For stability, two beams 153 each form a stabilizing triangle joint between lower lateral beam 152 and each vertical beam 102. Beams 154 also each form a stabilizing triangle joint between lower lateral beam 152 and horizontal beam 101.

The spotter system 100 can have a bench press board 110, to support the weightlifter for various exercises, such as the bench press. Board 100 is supported by uprights 111 and 112. Upright 112 can be secured in holes 113 in horizontal beams 101 by pins 114, to secure the location of board 110 relative to spotter system 100. By securing the location of board 110 relative to spotter 100, the safety of the weightlifter can be enhanced and the efficiency of the exercise improved.

A pair of vertical smooth shafts 106 are fixedly held in parallel between horizontal beams 101 and top beams 104. Shafts 106 each have stop ring 107 to hold the shaft in place against top beams 104. A pair of brackets 108 each support a clamp 109. Each clamp 109 grips one of shafts 106.

Spotter-arms connecting-plate 131 is slidably attached to vertical smooth shafts 106 via top ball bushing 136 and bottom ball bushing 137. The spotter arms 132 are held in place via this spotter-arms connecting-plate 131. Each spotter arm 132 has a forward vertical protrusion 133 and a rearward vertical protrusion 134, to keep the barbell confined on the spotter arms 132 when the barbell is resting on spotter arms 132. One or both of spotter arms 132 have a contact sensor 135 on the upper surface of the spotter arm 132, between forward vertical protrusion 133 and rearward vertical protrusion 134. Internally threaded nut 125 is attached to nut mount 130. Nut mount 130 is connected to spotter-arm connecting-plate 131 via reinforcing plate 138.

Direct current (DC) motor 120 rests on motor mount 121. DC motor 120 is chosen among motors commercially available, to deliver torque to gear box 122. Gear box 122 can have two purposes. The first purpose may include providing a mechanical advantage (MA) to the torque of DC motor 120, at the expense of motor RPM (revolutions per minute). Thus, the gear box 122 will multiply the torque of motor 120 by a factor of MA while dividing the RPM of DC motor 120 by the same factor of MA. This torque-speed tradeoff can provide increased torque to lead screw 124. It is possible that gear box 122 may simply have a mechanical advantage of unity. Gear box 122 has a second purpose, in FIG. 1, which is to provide a right-angle change to the direction of the torque generated by DC motor 120.

Gear box 122 is connected to flexible coupling 123, to accommodate misalignment between lead screw 124 and gear box 122. Flexible coupling 123 is then connected to lead screw 124. Lead screw 124 is an externally-threaded shaft. Lead screw 124 may also be called a power screw. Lead screw 124 passes through internally threaded nut 125. The external threads of lead screw 124 and internal threads of nut 125 are identical in pitch and thread profile, to allow these two members to be in mating rotational contact. Lead screws can have threads with profiles including square threads, modified square threads, Acme threads, stub Acme threads, 60-degree threads, or national buttress threads. Both nut 125 and lead screw 124 should have the same direction of thread, either right-handed or left-handed. Thus, it is critical that the nut and the lead screw have both the same pitch, the same thread profile, and the same right or left handedness of the thread.

The rotation of lead screw 124 about the vertical axis moves mating nut 125 either up or down, depending on the rotation of lead screw 124. DC motor 120, gear box 122, flexible coupling, 123, lead screw 124, and mating nut 125 form a power-train subassembly. Since nut 125 is mechanically connected to the spotter arms 132, rotation of DC motor 120 raises or lowers the spotter arms 132, depending on the direction of rotation of DC motor 120.

The above power-train subassembly is the preferred embodiment. However, other power-train subassemblies could be used in spotter system 100. DC motor 120, gear box 122, flexible coupling, 123, lead screw 124, and mating nut 125 could be inverted from that shown in FIGS. 1–3, where the DC motor could be suspended from the top of the frame and the gear box and lead screw could be underneath the motor. Alternately, DC motor 120, gear box 122, flexible coupling, 123, lead screw 124, and mating nut 125 could be replaced by a hydraulic cylinder or a pneumatic cylinder. Either the hydraulic or pneumatic cylinders would serve the purpose of elevating or lowering spotter arms 132.

DC motor 120 has an integral encoder 360 for the purposes of providing rotation feedback to DC motor servo control 126. This same feedback is used for determining the rotational motion of lead screw 124 and, hence, the position of spotter arms 132. Such an encoder 360 is well known in the industry and typically has an internal disk which is either transparent or opaque. If this internal disk is transparent, it is typically made of glass with uniformly spaced dark radial lines etched on it. If this internal disk is opaque, it is typically stainless steel foil with uniformly spaced open radial slots etched in it. Either way, the internal disk is typically interposed between an internal light source and a light detector. As the internal disk rotates, it thus passes or blocks light and this is detected by the light source. One pair of alternating light and dark as detected by the light detector is called a count. If there is a pair of light sources and light detectors, the encoder is said to have quadrature, which means that the encoder can tell both the direction (clockwise or counterclockwise) as well as the magnitude (count) of the rotational motion of the internal disk. Typically counts in one rotational direction are considered positive and counts in the opposite rotational direction are considered negative. So, by summing the positive and negative counts, the sum of these counts gives the desired rotational position. By measuring the time duration between counts, the rotational velocity of the internal disk in revolutions per second, and hence the lead screw 124, can also be determined by the DC motor servo control 126.

This internal disk is connected to shaft of DC motor 120. Typically, encoders are classified by the number of lines per revolution, regardless of whether these lines are dark radial lines on transparent glass or open radial slots in opaque stainless steel foil. A 100 line encoder would have 100 uniformly spaced lines in the internal disk. Thus, if controller 126 measured 550 line counts, it would know that the internal disk and hence the DC motor 120 made 5.5 revolutions (550/100). If the mechanical advantage (MA) of the gear box 122 was unity, then the lead screw 124 would have also made 5.5 revolutions. In all subsequent example calculations, it will be assumed that the mechanical advantage of the gear box 122 is unity.

The external threads of lead screw 124 have a pitch p which is the amount of distance a point moves along the threads for one revolution of the lead screw 124. The units of pitch p are typically inches per revolution. The angular rotation and angular velocity of lead screw 124 are known by servo controller 126 via (a) the encoder feedback from DC motor 120 and (b) the known mechanical advantage of gear box 122. DC motor servo control 126 can convert these angular rotation and angular velocity quantities into linear vertical position and linear vertical velocity by multiplying these angular quantities by the pitch of the lead screw p and then dividing by the mechanical advantage of the gear box 122. Assuming that the gear box has a mechanical advantage of unity, if the count of a 100 line encoder is +550, the lead screw 124 has turned +5.5 revolutions (+550/100). If the pitch p is 1 inch, then the lead screw 124 has raised nut 125 and spotter arms 132 +5.5 p or 5.5 inches. Similarly, if the encoder disk, and hence the lead screw 124, is rotating at +10 revolutions per second, the vertical velocity of the nut 125 and spotter arms 132 are equally +10 p or +10 inches per second. This is summarized in the following equations, equations 1–2, which would be calculated by DC motor servo control 126. Control 126 would need to have the number of lines of encoder 360 and the mechanical advantage of gear box 122 stored in its memory to convert the line count into revolutions.

Vertical position of spotter arms 132, in inches=(motor revolutions)*(inches/screw-revolution)/(mechanical advantage) (eq.1)

Vertical velocity of spotter arms 132, in inches/second=(motor revolutions/second)*(inches/screw-revolution)/(mechanical advantage) (eq.2)

Figure 4:
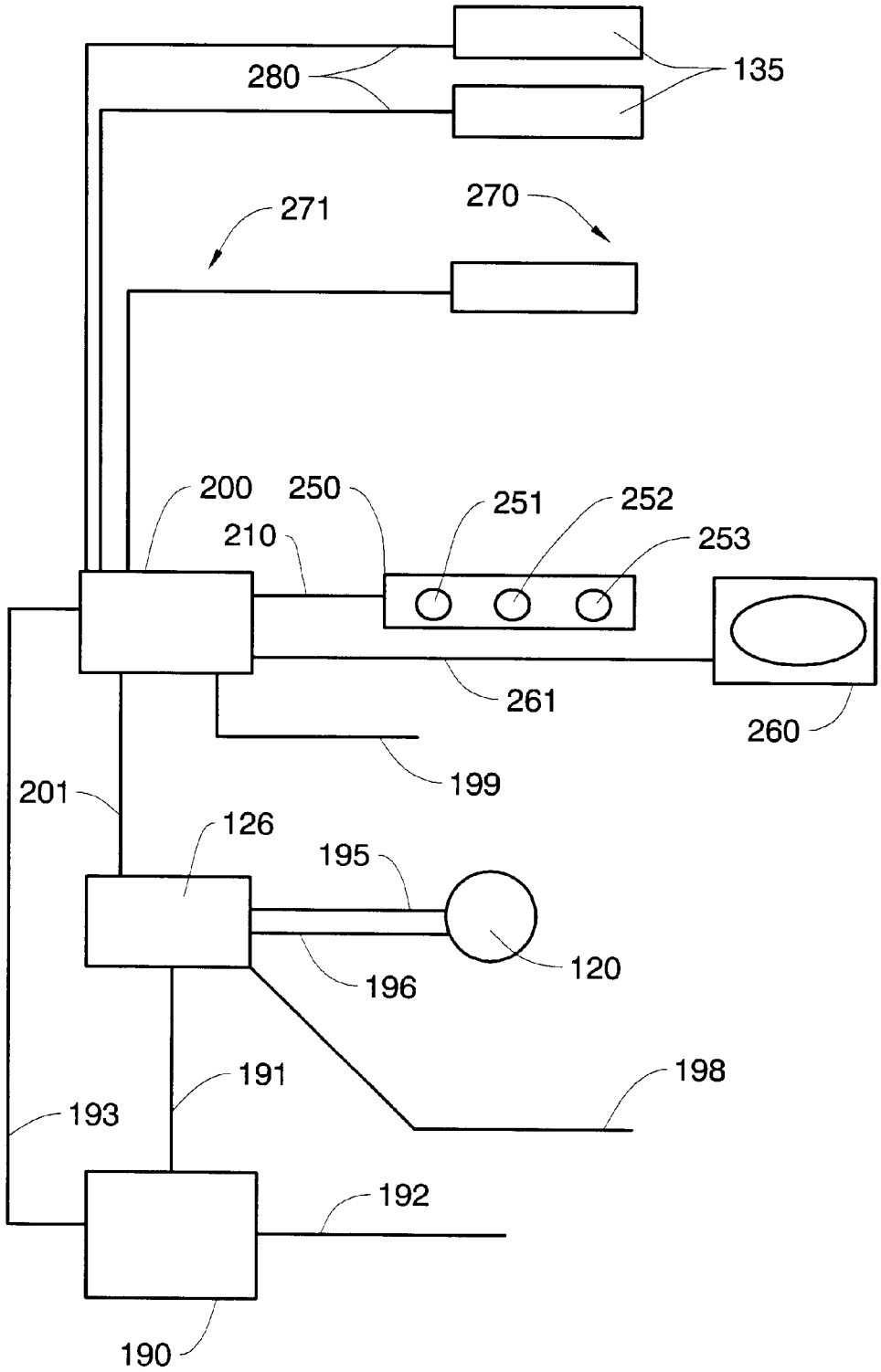
FIG. 4 shows the cabling of the spotter system.

In FIG. 4, this cabling diagram shows that DC motor servo control 126 provides current and voltage to DC motor 120 via power cable 195. Cable 196 provides the encoder signal from the rotation of DC motor 120 to DC motor servo control 126. This DC motor servo control 126 could be a dedicated unit, as shown in FIGS. 2–4, or it could be a card inside of a personal computer 200 or a laptop or other microprocessor configuration. Alternately, computer 200 could be resident inside of DC motor servo control 126. Computer 200 and DC motor servo control 126 communicate via cable 201.

Either DC motor servo control 126 or computer 200 holds key parameters, such as spot position A, the low limit of exercise motion B, and the upper and lower limits of permitted-travel of spotter arms 132. The upper and lower limits of travel of spotter arms 132 are needed so that the spotter arms will not collide with beams 104 or 101 when positions A and B are being defined by the weightlifter. Other key parameters would include how far to lower the spotter arms 132 from the lower limit of exercise B, so that spotter arms are out of the way during the free-weight exercise period. There may be a database for the weightlifter which stores the positions A and B for that person, based on the exercise done. Thus, the weightlifter would not have to reenter positions A and B every time an exercise was done.

Uninterruptable power supply (UPS) 190 provides backup power to DC motor servo control 126 via power cable 191. UPS 190 is connected to a standard wall outlet or other power outlet via power cable 192. DC motor 120 could have an internal brake which locks the motor from further rotation once power is cut to it. In case of a power outage, DC servo control 126 would first move spotter arms 132, and hence the exercise weights, to spotter position A before cutting power to such a DC motor with an internal brake.

UPS provides backup power to computer 200 via power cable 193. Computer 200 normally gets its power from a standard wall outlet or other power outlet via power cable 199. Similarly, controller 126 normally gets its power from a standard wall outlet or other power outlet via power cable 198.

The amount of current needed to be supplied by DC motor servo control 126 to DC motor 120 to raise or lower the barbell can be estimated by the following screw-torque equations for a single-threaded lead-screw.

$$\text{Lift screw-torque} = \frac{FT*d}{2} * \frac{p + PI*u*d}{PI*d - u*p} + \frac{FT*u*d}{2} \quad \text{(eq.3)}$$

$$\text{Lower screw-torque} = \frac{FT*d}{2} * \frac{p - PI*u*d}{PI*d + u*p} + \frac{Ft*u*d}{2} \quad \text{(eq.4)}$$

where p=pitch of single threaded lead screw 124 d=diameter of lead screw 124

PI=3.14159 u=coefficient of friction between lead screw 124 and mating nut 125

FT=weight of the barbells borne by spotter arms 132 plus the weight of the spotter arms 132, back plate 131, nut mount 130, and reinforcing plate 136

Dividing the screw-torque in equations 3–4 by (a) the torque constant Kt of DC motor 120 and (b) by the mechanical advantage of gear box 122 gives (c) the current needed to be provided by control 126 to DC motor 120 during the normal operation of the spotter arms 132. This calculation is shown in equation 5. This same current would have to be provided via UPS 190 to DC motor servo control 126 during emergency operation of the spotter arms 132.

Motor current=Screw-torque/(Torque constant*Mechanical advantage) (eq.5)

Equation 5 can be used to estimate the current required to lift, I(lift), and lower, I(lower), the spotter arms and the barbells being spotted. I(lift) is given in equation 6 and I(lower) is given in equation 7.

*I*(lift)=Lift screw-torque/(Torque constant*Mechanical advantage) (eq.6)

*I*(lower)=Lower screw-torque/(Torque constant*Mechanical advantage) (eq.7).

Paddle board 250 has setup button 251, exercise button 252, and spot button 253. Paddle 250 is connected to computer 200 via cable 210. Buttons 251–253 could be foot activated, if paddle 250 resides on the floor and the weightlifter is using his or her hands to hold the weights. However, if the weight lifter is using the spotter for leg exercises, the buttons 251–253 could be hand operated. Paddle 250 could be complimented by voice input 270 to computer 200, via cable 271. Alternately cables 210 and 271 could be an infrared "wireless" link to computer 200.

Computer 200 could display activity items to the weightlifter via display 260. Display 260 could be a liquid crystal display (LCD) or a common cathode ray tube (CRT) display. Display 260 is electrically connected to computer 200 via cable 261. Contact sensors 135 are connected to computer 200 via cables 280.

Position A shown in FIG. 1 is the upper limit of spot desired by the weightlifter. Position B is the lower limit of spot desired by the weightlifter. Positions A and B will vary from exercise to exercise for an individual. Positions A and B will vary from individual to individual for a given exercise. Thus, a setup phase is recommended to establish positions A and B for each user for each desired exercise.

Figure 5:
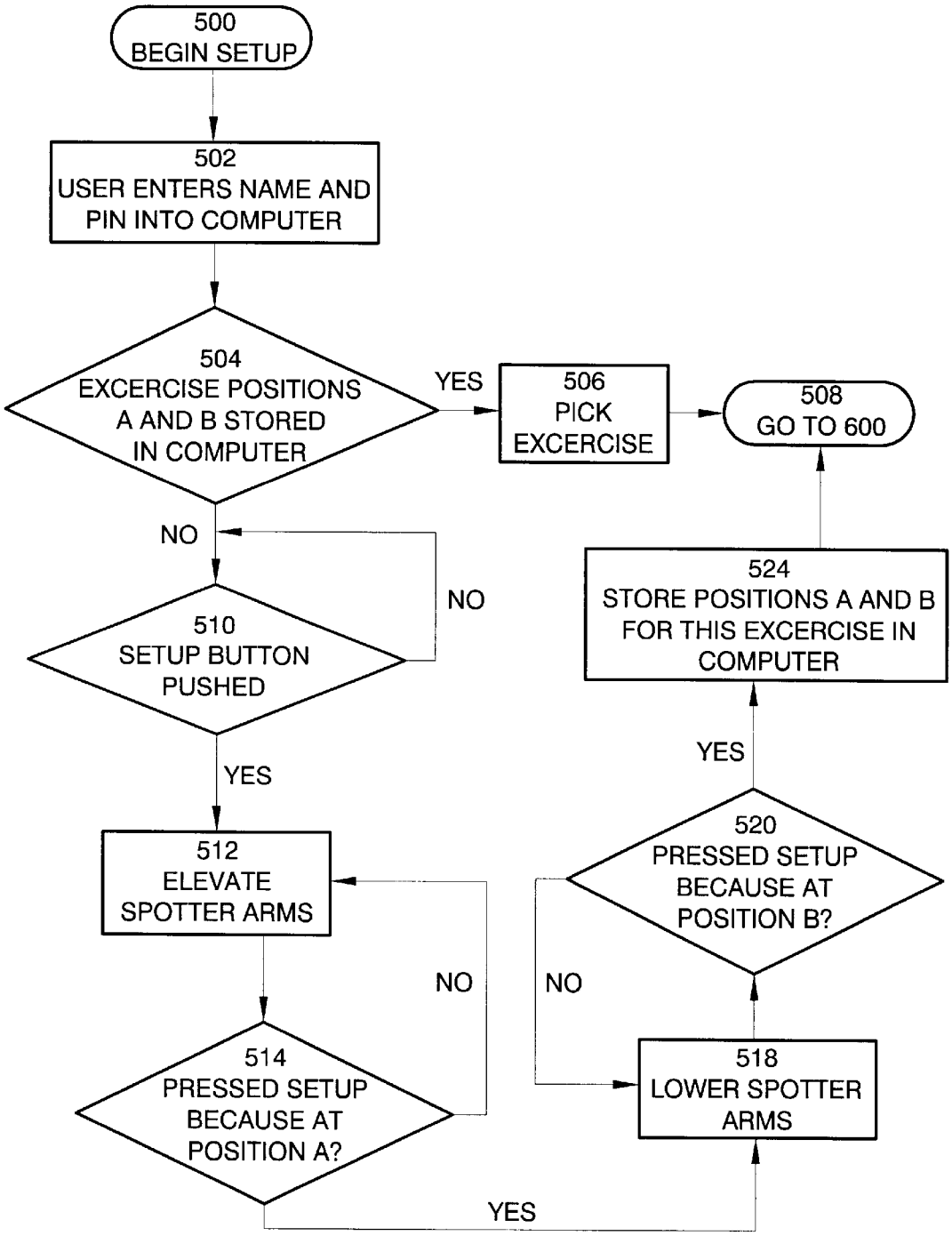
FIG. 5 shows the process of the setup phase.

FIG. 5 shows the beginning of the setup phase 500 of the use of spotter system 100. In step 502, the user enters his or her name and optional PIN (personal identification number) into computer 200. If the user has already established positions A and B for various exercises in step 504, the user picks which exercise he or she wants to perform in step 506. Then the process jumps to the exercise phase in step 508.

The reason for steps 502, 504, and 506 is that the user would not have to repetitively define exercise positions A and B each and every time the user desired to exercise. Weightlifters can be short or tall and exercises can range from squats (low exercises), to bench presses and curls (middle height exercises), to military presses done overhead (high exercises). Thus, positions A and B have to be defined.

If positions A and B are not already defined, the step 510 checks to see if setup button 251 was pushed. If not, step 510 cycles back to itself. If setup button 251 was pushed, step 510 jumps to step 512, where spotter arms 132 are elevated. Step 514 checks to see if setup button 251 was pushed again because spotter arms 132 are at the desired position A. If not, the process cycles back to step 512 and spotter arms 132 are elevated more. However, if setup button 251 is pushed in step 514, signifying the location of position A, spotter arms 132 are now lowered in step 518. Step 520 checks to see if setup button 251 was pushed again. If not, the process goes back to step 518 and spotter arms 132 are lowered more. If setup button 251 is pushed again in step 520, signifying the location of position B, the process goes to step 524, where the newly defined positions A and B for this exercise are stored in the computer 200. By storing values A and B, they will not have to be continually be redefined for this weightlifter. Then step 524 flows to step 508, to begin the exercise phase.

Figure 6:
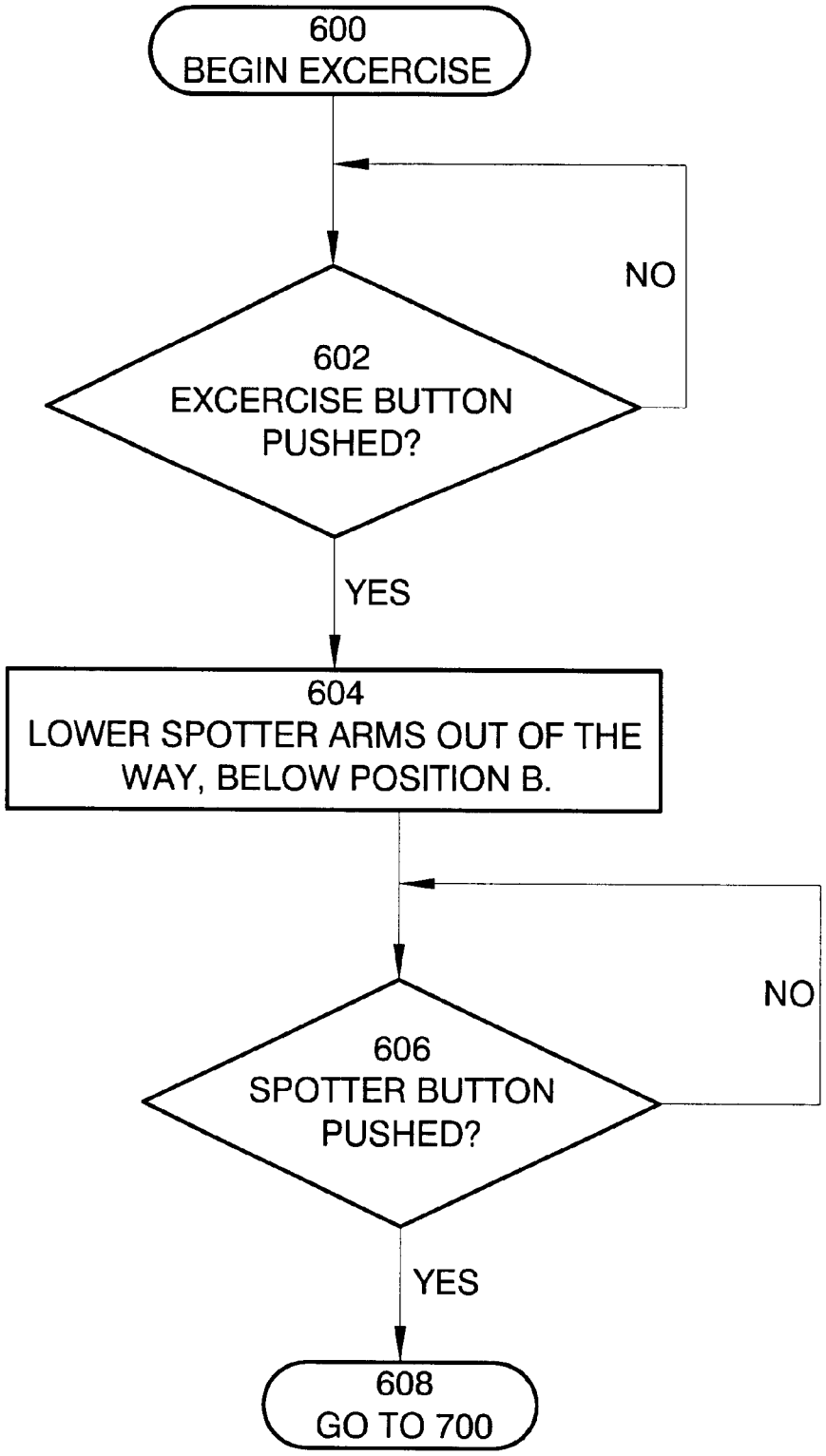
FIG. 6 shows the process of the exercise phase.
Figure 7:
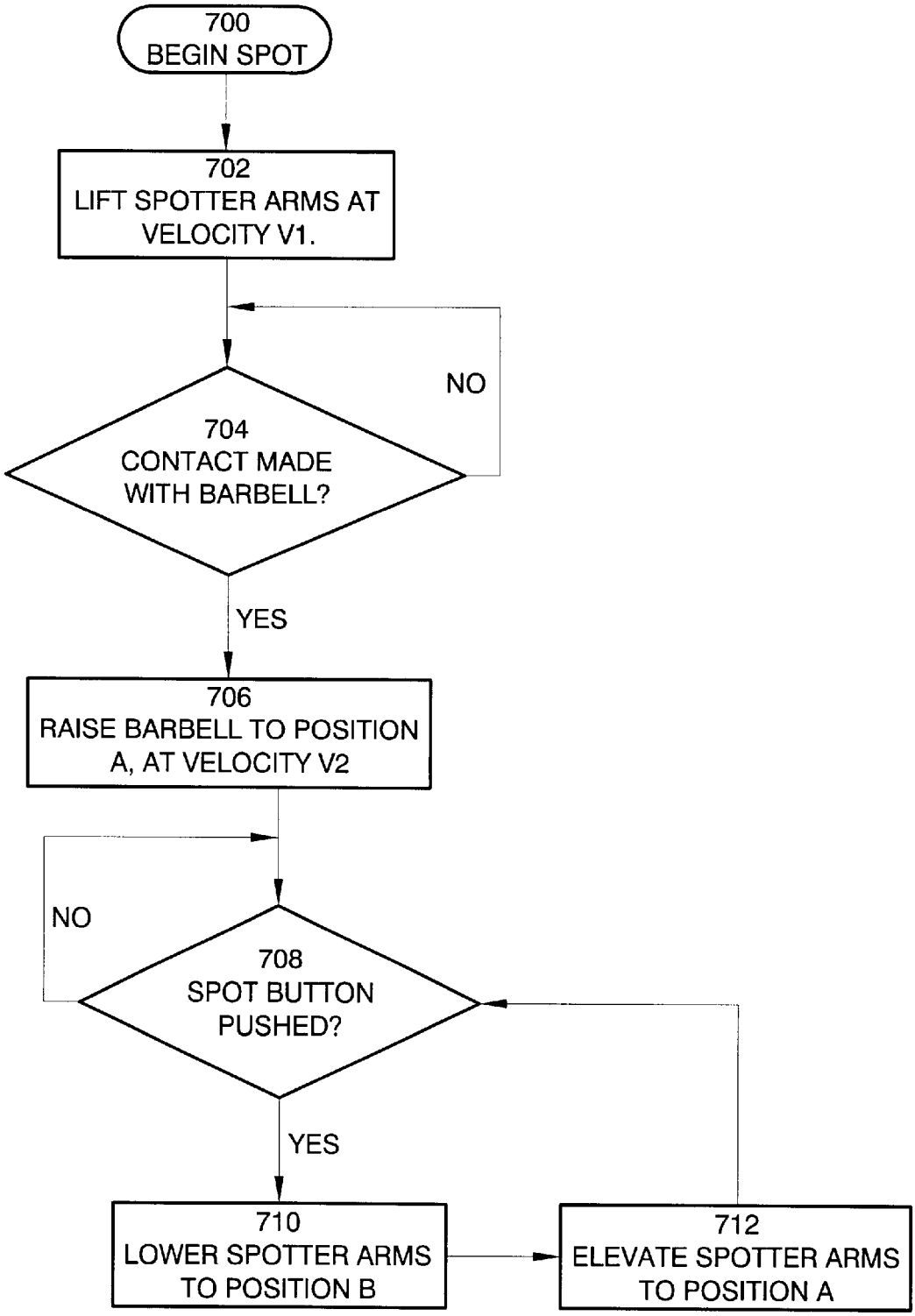
FIG. 7 shows the process of the spot phase.

In FIG. 6, the free-weight exercise phase begins with step 600. In step 602, the process checks to see if exercise button 252 was pushed. If not, the process cycles back to step 602. However, once exercise button 252 is pushed in step 602, spotter arms 132 are dropped below position B in step 604. How far spotter arms 132 are dropped below position B could be user-adjustable. Dropping spotter arms 132 to their lowest possible position could be done. Alternately, spotter arms 132 could be dropped a fixed distance below position B, such as 6 inches below position B. After the spotter arms are dropped out of the way, the user may engage in free weight lifting until he or she presses spot button 253, in step 606. If spot button 253 is not pressed, step 606 cycles back to itself. However, once spot button 253 is pressed in step 606, the process flows to step 608 and the spot phase begins.

The spot phase begins in step 700. The process moves to step 702, where spotter arms 132 lift at vertical velocity V1. Vertical velocity V1 may be set in computer 200 or DC motor servo control 126 by either the factory or by the weightlifter. Step 704 checks to see if contact has been made with the barbells yet. Contact would be determined by either (a) contact sensors 135 or (b) ajump in the motor current provided to DC motor 120 by DC motor servo control 126 once the weight of the barbells is engaged by spotter arms 132, per equations 3 and 5. Once contact is made by spotter arms 132 with the barbells, the barbells are raised to position A at a velocity V2, in step 706. Velocity V2 is preferably less than velocity V1, or may be equal to it. The user may set velocity V2 to his or her preference and store it in computer 200 in her user profile.

Once at position A, step 708 checks to see if the spot button 253 was pushed again. If not, step 708 cycles back to itself. However, if the spot button 253 was pushed again, the spotter arms 132 are lowered to position B in step 710 and then raised back to position A in step 712, before cycling back to step 708. In this manner, the weightlifter can bear as much of the weight on the barbells as he or she can, while taking advantage of the spot to bear a portion of the weight of the barbells. At this point, the weightlifter can cycle through as many individual spots as he or she desires before returning to step 504 and beginning a new exercise.

The coefficient of friction in equations 3–4 can vary with temperature, age, and environment. However, equations 3–7 can provide the background for estimating the percentage of the weight being spotted by the spotter system 100 and the amount being actually lifted by the weightlifter without precise knowledge of the coefficient of friction. By controller 126 cycling the spotter system (a) with the barbell through a spot cycle, steps 708, 710, and 712, and (b) without the barbell through an identical spot cycle, (c) each time without the weightlifter touching the barbell or the spotter arms, then (d) the current supplied to DC motor 120 to lift the barbell during a 100% spot-lift ILIFT(100) and a 0% spot lift ILIFT(0) can be empirically measured. This is called the 100% spot-calibration and the 0% spot-calibration.

By measuring the current ISPOT during the actual lift portion of step 712, the percent of the weight of the barbell being spotted is defined by equation 8 and the percent of the weight of the barbell being supported by the weightlifter is defined by equation 9.

$$\text{Percent spotted} = \frac{ISPOT - ILIFT(0)}{ILIFT(100) - ILIFT(0)} * 100\% \qquad \text{(eq.8)}$$

$$\text{Percent lifted} = \frac{ILIFT(100) - ISPOT}{ILIFT(100) - ILIFT(0)} * 100\% \qquad \text{(eq.9)}$$

For example, if ILIFT(100) equals 12 amperes, ILIFT (0)=2 amperes, and ISPOT during step 712 is 6 amperes, then the percent lifted is 60%, [(12-6)/(12-2)]. Similarly, the percent spotted is 40%, [(6-2)/12-2)].

The sum of equations 8–9 is unity, meaning that the percent spotted plus the percent lifted add up to 100%, as expected. It should be noted that ILIFT(0) the current necessary to lift the weight of just the articulated portion of spotter system 100, namely (a) spotter arms 132, (b) spotter-arm connecting-plate 131, (c) reinforcing plate 138, (d) internally threaded nut 125, and (e) nut mount 130, could be measured at the beginning of the exercise period for that day or at some other convenient time. ILIFT(0) need not be measured for each exercise. However, ILIFT(100) would have to be measured each time the weight of the barbell changed.

The results of the estimated percentages of (a) weight spotter and (b) actually lifted during the spot phase, step 712, could be displayed on display 260. The calculations required by equations 8–9 would be done by computer 200. Computer 200 would know the current used during step 712 by querying DC motor servo control 126, both during the 100% spot-calibration and during the actual spotting of the weightlifter. As previously described, it is DC motor servo control 126 which is providing that current to DC motor 120.

Equations 1–9 could equally be solved in System International (SI) units, which are commonly called metric units in the United States.

One last feature of this invention has to do with designing lead screw 124 to be self-locking, meaning that in the event of a compound failure, namely a power outage of normally available power and the failure of the UPS 190, that the barbell and spotter arms 132 do not descend down upon the weightlifter. The term self-locking does not mean that the lead screw 124 and nut 125 "freeze." Rather, the term self-locking means that the coefficient of friction between the lead screw 124 and nut 125 is sufficient that the barbell and spotter arms 132 stay in place based on friction alone, without the assistance of electrical power to DC motor 120. If lead screw 124 has a square thread, the condition for self-locking is that the pitch p of lead screw 124 is equal to the diameter d of the lead screw 124 times PI times the coefficient of friction u between lead screw 124 and nut 125. This is given in equation 10. Thus, by prudent selection of the lead screw 124 and nut 125, additional safety can be designed into spotter system 100.

$$\text{pitch } p = \text{diameter } d * PI * \text{coefficient of friction } u \qquad \text{(eq.10)}$$

While the invention has been shown and described with reference to a particular embodiment thereof, it will be understood to those skilled in the art, that various changes in form and details may be made therein without departing from the spirit and scope of the invention.

I claim:

1. An automated spotting device to assist weight lifters in performing weight lifting exercises with barbells, comprising:

a pair of smooth shafts;

a frame, said frame fixedly holding said smooth shafts vertically and in parallel;

a pair of bushings, said bushings in sliding engagement along said smooth shafts;

a pair of spotter arms;

a spotter arm connecting plate, each of said spotter arms attached to said connecting plate and said connecting plate attached to said bushings;

a nut having an internal thread of known profile, said nut attached to said connecting plate;

a motor having a shaft, said motor attached to said frame; and a lead screw, said lead screw having an external thread profile matching the profile of the internal thread of said nut, said lead screw passing through said nut, such that said nut and said lead screw are in mating rotational contact, whereby as said DC motor rotates said lead screw, said spotter arms are raised or lowered along said smooth shafts.

2. The automated spotting device, as defined in claim 1, wherein said bushings are ball bushings.

3. The automated spotting device, as defined in claim 1, further comprising:

a flexible coupling, said lead screw having an end, said flexible coupling having first and second ends, the first end of said flexible coupling is attached to the end of said lead screw; and a gear box, said gear box attached to the second end of said flexible coupling and to the shaft of said motor.

4. The automated spotting device, as defined in claim 1, further comprising:

a controller; and an encoder, said encoder attached to the shaft of said motor, said encoder providing positional and velocity feedback to said controller.

5. The automated spotting device, as defined in claim 4, further comprising:

a contact sensor, said contact sensor attached to one of said spotter arms, said contact sensor providing feedback to said controller as to whether said barbells are in contact with said spotter arms.

6. The automated spotting device, as defined in claim 5, wherein said spotter arms have two vertical protrusions, said vertical protrusions restrain said barbell when said barbell is resting on said spotter arms, and said contact sensor resides between said vertical protrusions.

7. The automated spotting device, as defined in claim 5, wherein said controller raises the spotter arms at one predetermined velocity when the barbells are not in contact with said spotter arms and raising the spotter arms at another predetermined velocity when the barbells are in contact with said spotter arms.

8. The automated spotting device, as defined in claim 1, further comprising:

a display electronically connected to said controller, said display provides a visual readout of information stored in said controller.

9. The automated spotting device, as defined in claim 1, further comprising:

a voice recognition system connected to said controller, said voice recognition system providing command inputs to said controller.

10. The automated spotting device, as defined in claim 1, further comprising:

a control button for indicating setup, a control button for indicating free exercise, and a control buttons for indicating spotting;

said control buttons residing on a paddle board; and said paddle board providing command inputs to said controller.

11. The automated spotting device, as defined in claim 10, wherein said paddleboard communicates with said controller via a wire cable.

12. The automated spotting device, as defined in claim 10, wherein said paddleboard communicates with said controller via infrared wireless communication.

13. The automated spotting device, as defined in claim 1, further comprising:

a bench press board, said bench press board is removably attached to said frame.

14. The automated spotting device, as defined in claim 1, wherein said lead screw and said nut are self-locking, whereby said spotter arms are safely held in place based on friction alone in the advent of a power loss to said motor.

15. A method for controlling an automated spotting device that assists weight lifters in performing weight lifting exercises with barbells, comprising the steps of:

initializing a controller with a set of parameters indicating an upper and a lower extreme of exercise motion;

lowering a spotter arm out of the way to permit free exercise with said barbells;

raising spotter arm when commanded by said weightlifter, to spot said barbells; and cycling said spotter arm from a upper position, to a lower position, and then returning to the same upper position as commanded by said weightlifter.

16. The method as recited in claim 15, further comprising the steps of:

storing said set of parameters indicating an upper and a lower extreme of exercise motion in a database for future use.

17. The method as recited in claim 15, further comprising the steps of:

determining whether said barbells are in contact with said spotter arms;

raising said spotter arms at a first velocity when said barbells are not in contact with said spotter arms; and raising said spotter arms at a second, lower velocity when said barbells are in contact with said spotter arms.

18. The method as recited in claim 15, further comprising the steps of:

activating a backup power supply for a motor when said motor loses a main power supply; and moving said spotter arm to a safe position before said backup power supply is completely used.

19. The method as recited in claim 18, further comprising the steps of:

engaging a brake in said gear motor once said backup power supply is cut to said gear motor, thereby preventing further motion of the gear motor.

20. The method as recited in claim 15, further comprising the steps of:

measuring a current;

calculating a percent of said barbell weight; and indicating said percentage of said barbell weight.

* * * * *